US005160278A

United States Patent [19]

Johnson

[11] Patent Number: 5,160,278

[45] Date of Patent: Nov. 3, 1992

[54] REAGENT STRIP CALIBRATION SYSTEM

[75] Inventor: Larry D. Johnson, Mill Creek, Ind.

[73] Assignee: Miles Inc., Elkhart, Ind.

[21] Appl. No.: 600,906

[22] Filed: Oct. 22, 1990

[51] Int. Cl.[5] ..... H01R 13/00

[52] U.S. Cl. ..... 439/593; 439/493

[58] Field of Search ..... 439/86, 90, 91, 197, 439/493, 586, 592, 593

[56] References Cited

U.S. PATENT DOCUMENTS

| | | | |
|---|---|---|---|
| 2,874,363 | 2/1959 | Ainsworth | 439/593 |
| 2,978,666 | 4/1961 | McGregor | 439/197 |
| 3,202,955 | 8/1965 | McKee | 439/586 |

FOREIGN PATENT DOCUMENTS

| | | | |
|---|---|---|---|
| 1054929 | 11/1983 | U.S.S.R. | 439/586 |

*Primary Examiner*—Joseph H. McGlynn
*Attorney, Agent, or Firm*—Roger N. Coe

[57] ABSTRACT

A reagent strip calibration system utilizes an electrical connection system particularly usable for making electrical connections to one-time use devices such as reagent strips. The connection employs a plurality of U-shaped contacts fabricated from a hard metal wire such as tungsten, beryllium copper or a nickel/iron alloy that is self-supporting or supported by an elastomer that also provides contact pressure between the wire and the one-time use device while providing low insertion force. Such a connection system is particularly suitable for use with a system for analyzing the chemical properties of an analyte that is placed on a reagent strip. The manner in which the chemical properties of the reagent strip are to be analyzed are defined by areas of different resistance disposed on the reagent strip and contacted by the U-shaped contacts to permit measurement of the resistance of the various areas to obtain the information needed to define the properties of the reagent strip.

8 Claims, 6 Drawing Sheets

REAGENT STRIP CALIBRATION SYSTEM

BACKGROUND OF THE INVENTION

1. Field of the Invention

This invention relates generally to reagent strips and reagent strip handling systems, and more particularly, to systems that utilize reagent strips, for example, for the purposes of analyzing body fluids, such as blood, for specific analytes or chemical properties, such as, for example, blood sugar.

2. Description of the Prior Art

Various systems for analyzing the chemical properties of fluids, such as bodily fluids, for specific chemical properties utilizing reagent strips are known. Such systems are often used to measure the glucose level of blood. In such systems, a blood sample is placed on a reagent strip and optically analyzed by a light detection device, such as a light detection photometer, to determine the level of glucose in the blood. Such systems analyze the characteristics of the light reflected from the specimen on the reagent strip to determine specific chemical properties of the analyte specimen. However, the characteristics of the reflected light are determined not only by the chemical properties of the analyte, but also by the chemical properties of the reagent on the reagent strip. Consequently, much effort is expended in attempting to obtain uniformity between different batches of reagent strips that are manufactured; however, due to manufacturing tolerances, there is still some variation. This variation can affect the accuracy of the analytical readings obtained from the specimen.

In order to overcome the variations in readings caused by variations in the reagent strips, several methods for compensating for the variations in the reagent strips have been utilized. In such systems, the characteristics of the reagent strip are first determined, and data defining the particulars of the reagent strip is utilized to compensate the analysis process for variations between batches of reagent strips. The batch specific information that defines the characteristics of the particular batch of reagent strips can be printed on the reagent strips or on a box of reagent strips and manually entered into the analyzing device to provide for such compensation. One such system is disclosed in U.S. Pat. No. 4,852,025. In other systems, the batch specific information can be coded on the reagent strip itself and read by the analyzing device to eliminate the need for a manual entry of data. Such data can be encoded on the reagent strip in the form of a bar code as disclosed in U.S. Pat. Nos. 4,476,149; 4,510,383; and 4,592,893 or in a magnetic format, such as disclosed in U.S. Pat. No. 4,578,716.

While such systems do provide a way to compensate for variations between batches in the parameters of reagent strips, the manual entry methods require the attention of an operator and are subject to input error, while the optical and magnetic systems require sophisticated reading equipment.

SUMMARY

Accordingly, it is an object of the present invention to overcome many of the disadvantages associated with prior art systems.

It is another object of the present invention to provide a system for analyzing chemical properties of fluids placed on a reagent strip that compensates for variations in the reagent strips.

It is another object of the present invention to provide a system that automatically compensates for variations in the characteristics of the reagent strips.

It is yet another object of the present invention to provide a system that automatically reads data defining the characteristics of a reagent strip that is encoded on the reagent strip in the form of a plurality of areas of differing resistance.

It is another object of the present invention to provide a connector particularly suitable for making contact to a one-time use device, such as a reagent strip, to permit data from the one-time use device to be read.

It is another object of the present invention to provide a reagent strip having an encoded area disposed thereon, wherein the encoded area contains data defining the parameters of the reagent strip in the form of a plurality of electrically conductive areas of differing resistance.

Thus, in accordance with a preferred embodiment of the invention, there is provided a reagent strip having data defining the particulars of the reagent strip encoded thereon in the form of one or more electrically conductive areas of different resistance encoded thereon. The system utilizes a probe that reads the resistance of the resistive areas and calibrates the analyzing system to compensate for variations in the reagent to improve the accuracy of the readings.

An electrical connector particularly suitable for use in conjunction with one-time use devices such as reagent strips provides a reliable contact between a reagent strip and the analyzing device to assure an accurate reading of the resistance of the resistive area or areas on the reagent strip. The connector utilizes a plurality of generally U-shaped tungsten wires disposed about a generally cylindrical member fabricated from a polymer elastomer such as urethane to provide electrical contact to the electrically conductive area or areas on the reagent strip. The polymer elastomer provides the necessary contact force between the tungsten wire and the reagent strip while maintaining good wiping action and electrical contact while maintaining a low insertion force. The low insertion force minimizes damage to the reagent strip, and the hardness of the tungsten wire provides a long-life connector.

BRIEF DESCRIPTION OF THE DRAWING

These and other objects and advantages of the present invention will become readily apparent upon consideration of the following detailed description and attached drawing, wherein.

DETAILED DESCRIPTION OF THE PREFERRED EMBODIMENTS

Figure 1:
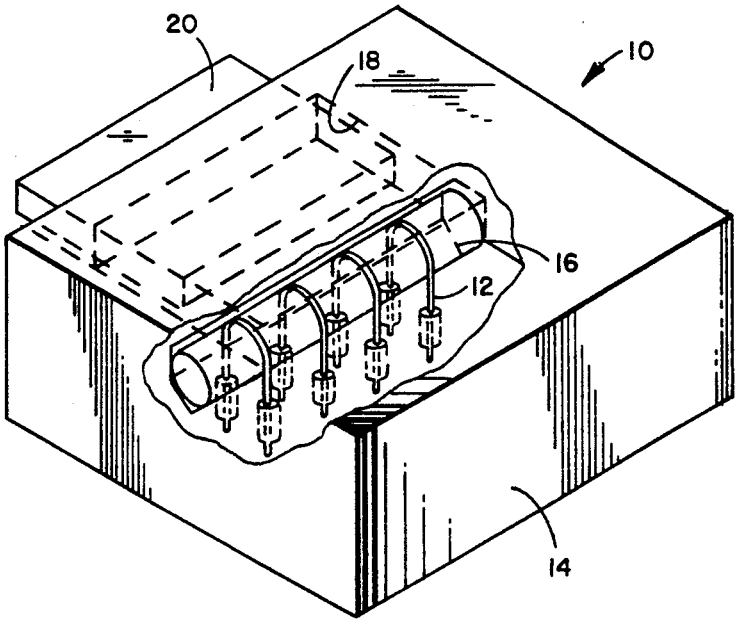
FIG. 1 is a perspective view showing a connector for use in conjunction with the present invention.

Referring now to the drawing, with particular attention to FIG. 1, there is shown a connector particularly suitable for making electrical contacts to a disposable member, such as a reagent strip to permit data encoded on the reagent strip to be read. In the embodiment illustrated in FIG. 1, there is provided a connector, generally designated by the reference numeral 10, that has a plurality of U-shaped members 12 that are supported within a housing 14. Each of the U-shaped conductors 12 is fabricated from a hard, electrically conductive material, preferably tungsten, that is supported by a resilient member 16. Alternatively, other hard conductive alloys such as beryllium copper or a nickel/iron alloy can be used. The resilient member 16 can be any suitable insulating member such as an elastomer, for example, butadiene rubber, butyl rubber, polychloroprene (Neoprene) or natural rubber. An opening 18 within the housing 14 serves to receive an encoded slide 20 that has areas of differing resistivity on the lower side thereof and metallized contacts adjacent the areas of resistivity that engage the contacts 12 of the connector to provide an electrical connection to the areas of different resistivity. Thus, the resistances between different ones of the conductors 12 define a code that can be used to define the characteristics of the slide 20.

Figure 2:
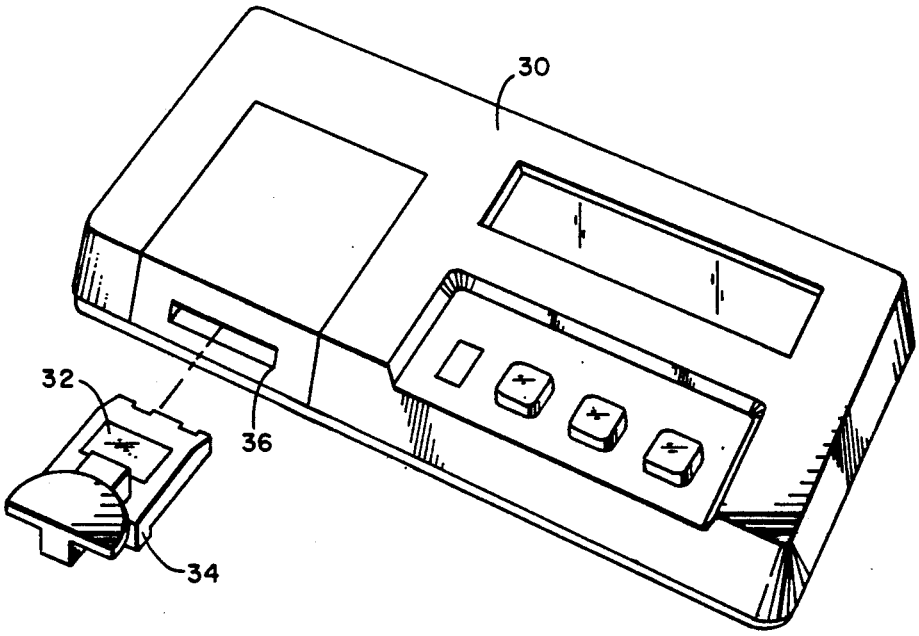
FIG. 2 is a perspective view of a reflectance photometer and slide employing the connector of FIG. 1.

As previously stated, the system is particularly useful for calibrating an analyzing instrument such as a reflectance photometer. One such reflectance photometer utilizing the invention is illustrated in FIG. 2. In FIG. 2, a reflectance photometer 30, which may be similar to a reflectance photometer used for measuring the glucose level in blood and manufactured under the trademark "GLUCOMETER" by Miles Inc. The reflectance photometer 30 utilizes a connector like the connector illustrated in FIG. 1 to make contact with a calibration coupon 32 that is disposed on the top surface of a slide 34 that contains a reagent on the bottom surface thereof. The coupon 32 contains data defining the chemical properties of the reagent material, and when the slide 34 is inserted into an opening 36 in the reflectance photometer 30, the data on the coupon 32 is read by a connector of the type illustrated in FIG. 1 disposed on the top wall of the opening 36 so that the contacts 12 extend downwardly and contact various resistive areas on the coupon 32.

Figure 3:
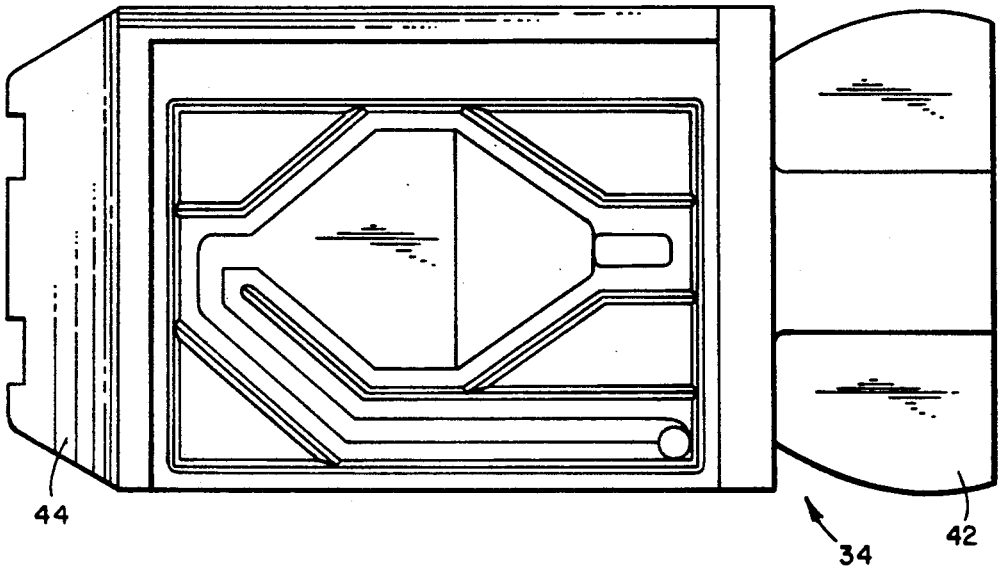
FIGS. 3–5 illustrate the slide of FIG. 2 in greater detail.
Figure 4:
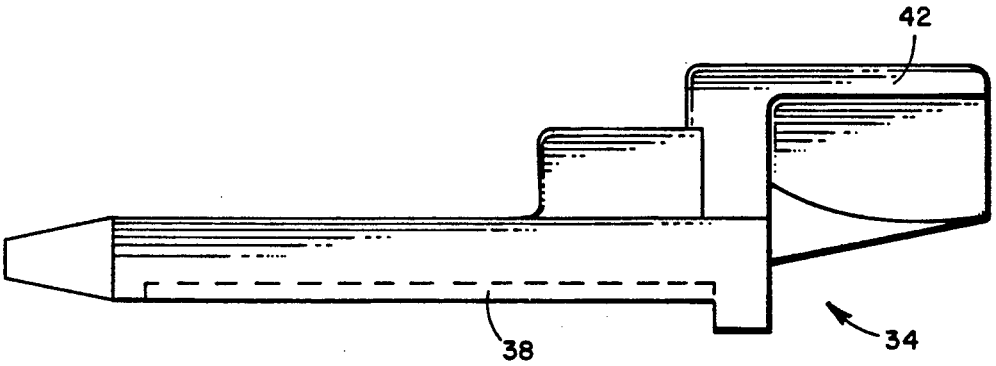
Figure 5:
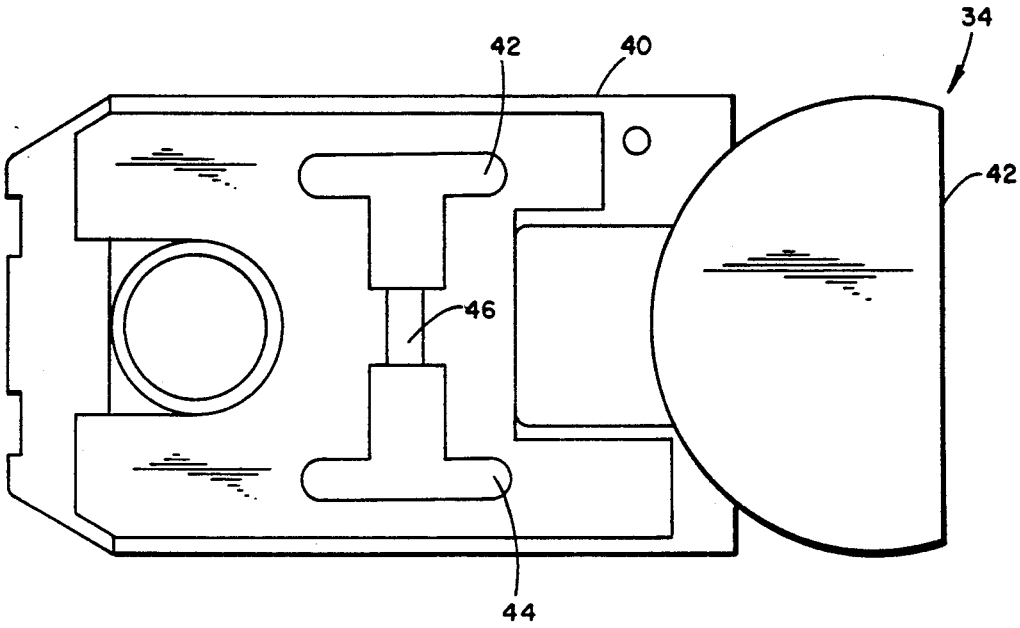

The side 34 is illustrated in greater detailed in FIGS. 3-5. The slide 34 is molded preferably from molded plastic and has a reagent strip 38 disposed on the bottom surface thereof, and a coupon or label 40 that contains information defining the chemical properties of the reagent strip 38 disposed on the top surface thereof. The slide 34 has a handle 42 to facilitate handling and a tapered front portion 44 to aid insertion and to minimize potential damage to the wires 12 of the connector 10 (FIG. 1) when the slide is inserted.

Referring to FIG. 5, the coupon 40 can be adhesively attached to the top surface of the slide 34 or can be molded into the body of the slide 34. In the embodiment illustrated in FIG. 5, the label or coupon 40 contains two conductive areas 42 and 44 that are in contact with a resistive element 46. The conductive areas 42 and 44 and the resistive area 46 can be formed by a thick film process using screen print technology. The two conductors can be fabricated from any suitable conductive material, such as copper or aluminum, and preferably silver in the illustrated embodiment. The resistive element 46 is preferably a carbon-based resistive element.

The resistance value of the element 46 defines the chemical properties of the reagent strip 38. Thus, when a batch of reagent strips is manufactured, the chemical properties are determined and the value of the resistive element 46 is selected accordingly. When the encoded slide 34 is inserted into the opening 36 of the reflectance photometer 30 (FIG. 2), the resistance of the element 46 is measured by the resistance measuring circuitry within the photometer 30 that has a pair of contacts similar to the contacts 12 illustrated in FIG. 1 that contact the areas 42 and 44. In the illustrated embodiment, the values of the resistive element 46 are spread over five decades centered on the values 100, 1,000, 10,000, 100,000 and 1,000,000 ohms. Thus, reagent strips having five different properties can be identified by selecting an appropriate one of the five ranges of resistances for the resistive element 46. The values of resistance are spaced by a factor of 10 so that the difference between the values can be readily ascertained using simple circuitry, and to permit large tolerances, such as ±20% in the values of the resistive element 46.

It should be noted that although the label illustrated in FIG. 5 contains only a single resistive element, several resistive elements can be used to encode a larger amount of data than that which can be encoded by a single resistive element. For example, utilizing two resistive elements, each having five different possible values, the number of different properties that can be encoded rises to 25 (5×5) and, if the number of resistive areas were increased to three, the number of possible values that could be encoded would be 125 (5×5×5). Also, by raising the number of values of resistance that could be assigned to each individual resistive element, a larger amount of data can be encoded; however, utilizing a greater number of possible resistive values requires greater accuracy in the fabrication of the resistive elements, and more accurate resistance measuring circuitry.

Figure 6:
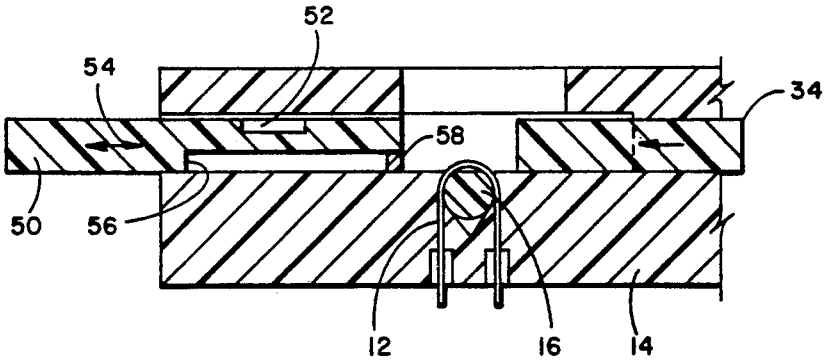
FIG. 6 is a side sectional view of an alternative embodiment of the connector illustrated in FIG. 1.

When the system according to the invention is used in conjunction with a reflectance photometer, a slide containing an optical reference for the reflectance photometer can also be employed. Such a slide is illustrated in FIG. 6. In FIG. 6, a slide 50 contains an optical reference 52 on its top surface. The slide 50 contains a narrowed portion 54, and is horizontally slidable from the position shown in FIG. 6 to a position wherein a step 56 on the slide 50 engages a stop 58 in the housing 14. The slide 50 can be spring loaded so as to urge the step 56 into contact with stop 58, so that when there is no slide 34 present in the cavity, the narrowed portion 54 overlies the contacts 12 and prevents damage to the contacts 12. The height of the step 56 is selected so that the narrowed portion 54 does not contact the contacts 12, which are shown extending from the bottom of the housing 14, but could also extend from the top of the housing when a slide such as the slide 34 shown in FIGS. 3-5 is used. When in this position, the optical reference 52 is in alignment with the optical viewing area of the reflectance photometer 30. The spring biasing force applied to the slide 50 also aids in the ejection of the slide 34.

Figure 7:
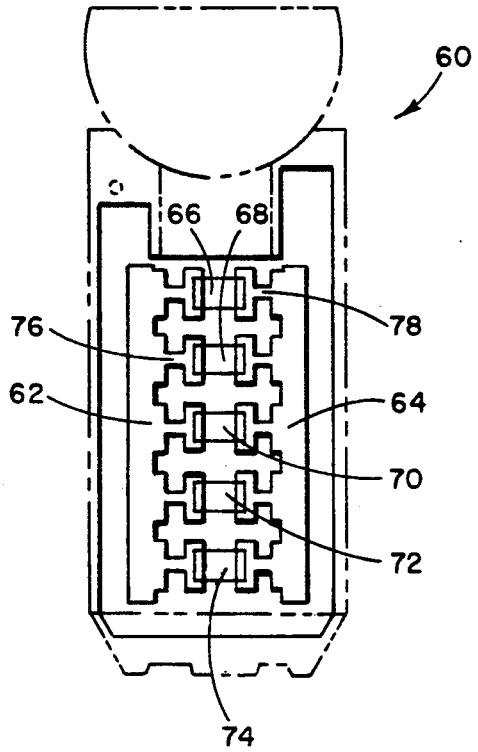
FIG. 7 is a plan view of a generic slide usable in conjunction with the present invention having data encoded in an analog format.

In the embodiment of the slide illustrated in FIGS. 3-5, the information defining the properties of the reagent strip was contained in the resistive area 46 whose resistance was selected to define the chemical properties of a particular batch of reagent strips. However, rather than providing a slide that is encoded with an area whose resistance is specific to a particular batch, a generic slide may be provided. One such generic slide is illustrated in FIG. 7. Referring to FIG. 7, the slide 60 has a pair of conductive areas 62 and 64 that are engageable by two contacts such as two of the contacts 12 of the connector 10. A plurality of resistive elements 66, 68, 70, 72 and 74 are connected in parallel between the conductive areas 62 and 64 by a plurality of fusible links 76 and 78. Preferably, each of the resistive areas 66, 68, 70, 72 and 74 has a different resistance and various ones of the resistive areas may be disconnected from the circuit by blowing appropriate ones of the fusible links 76 or 78 to disconnect preselected ones of the resistive areas from the circuit. Thus, various values of resistance defining various batch specific parameters may be obtained from a single generic slide by disconnecting appropriate ones of the resistive areas 66, 68, 70, 72 and 74 from the circuit.

Figure 8:
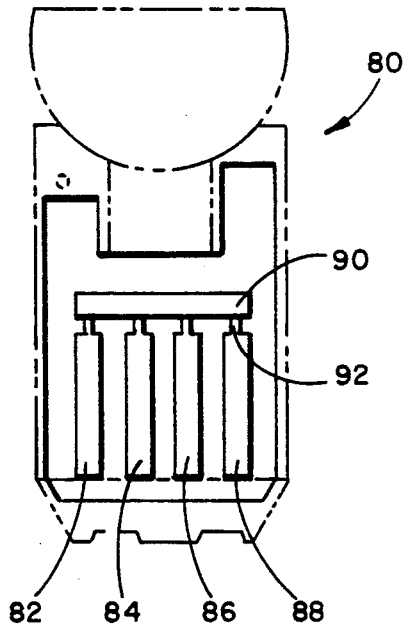
FIG. 8 is a plan view of a generic slide usable in conjunction with the present invention having data encoded in a digital format.

The information defining the chemical properties of the reagent strip may also be encoded digitally onto the slide. One such digital encoding slide is illustrated in FIG. 8. In the embodiment illustrated in FIG. 8, four conductive areas 82, 84, 86 and 88 are connected together via a conductive member 90 and four fusible links 92. Each of the conductive areas 82, 84, 86 and 88 can be contacted by one of the conductors 12 of the connector 10, and data selectively encoded by selectively blowing predetermined ones of the fusible links 92. Thus, information defining the chemical properties of the reagent can be determined by measuring which of the ones of the conductive areas 82, 84, 86 and 88 are connected together. For example, areas that are connected can define a "1" and disconnected areas can define a "0". The reading of data can also be accomplished by utilizing another contact on the connector that engages the area 90 and a determination can be made as to whether or not individual ones of the areas 82, 84, 86 and 88 are connected to the area 90.

Figure 9:
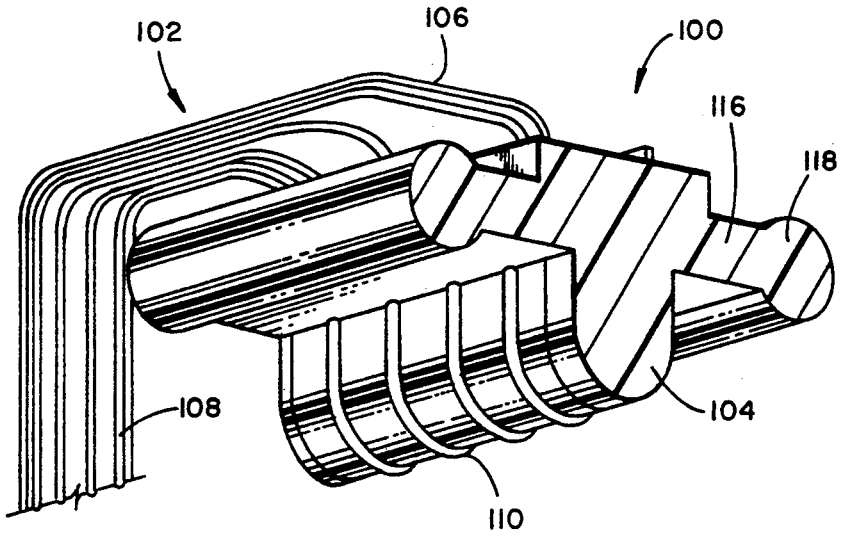
FIGS. 9 and 10 are perspective views of an alternative embodiment of the connector according to the present invention.
Figure 10:
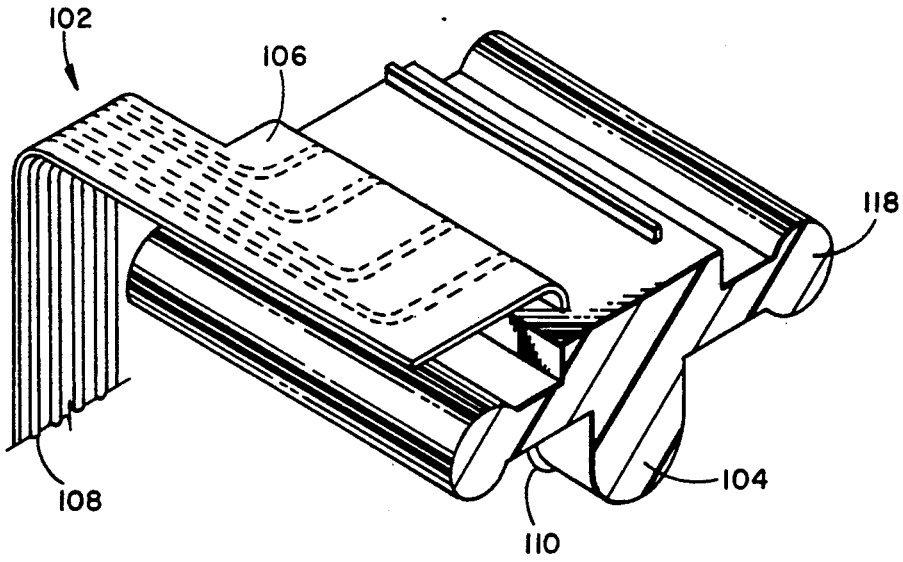

Referring to FIGS. 9 and 10, there is shown an alternative embodiment of a connector 100 usable in conjunction with the present invention. In the embodiment illustrated in FIGS. 9 and 10, a flexible circuit 102 is wrapped around an elastomeric body portion 104. The flexible circuit 102 may include a polyimide or polyester based backing material 106 having a plurality of copper conductors 108 plated thereon. A plurality of contacts 110 are affixed to the conductors 108 at the portion of the connectors surrounding the body portions 104. The contacts 110 are preferably fabricated from a hard, wear resistant material such as, for example, beryllium copper or a nickel/iron alloy. The contacts 110 are fabricated, for example, from a wire having a diameter of 0.004 inch that may be soldered to the copper conductors 108, or may be bonded thereto by a conductive adhesive.

Figure 11:
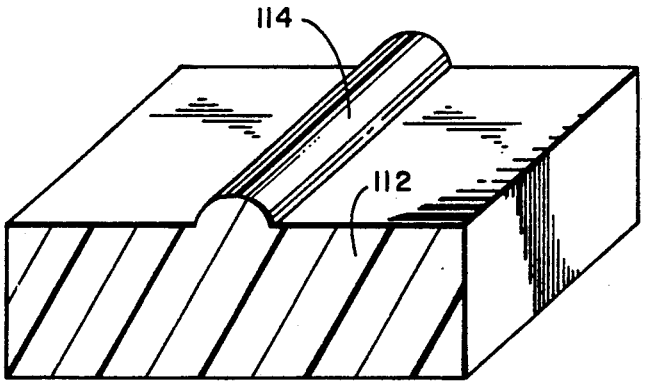
FIGS. 11 and 12 illustrate yet another embodiment of the connector according to the present invention.
Figure 12:
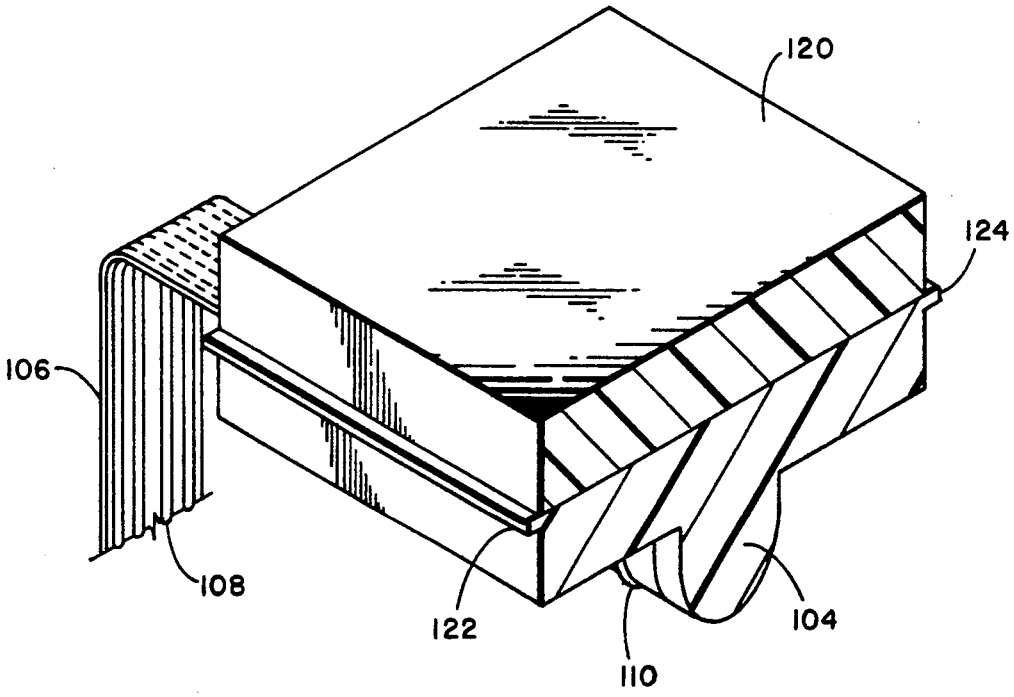

Alternatively, instead of utilizing a round wire for the contacts 110 as shown in FIGS. 9 and 10, a beryllium copper or nickel/iron strip 112 having a cross section as shown in FIG. 10 may be utilized in place of the contacts 110. In the embodiment illustrated in FIG. 11, the strip may have a width of, for example, 0.030 inch and a thickness of 0.010 inch and have a bead 114 extending from one end thereof. The bead 114 can have a diameter of 0.004 inch and serve as the contact surface for contacting the reagent strip. Such a strip can be self-supporting and eliminate the need for the supporting body portion 104.

The connector body including the body portion 104 can be molded over the flex print wire as illustrated in FIGS. 8 and 9. In addition, the body portion 104 may be flexibly supported by a pair of reduced thickness sections 116 extending therefrom to permit the contacts 110 resiliently to contact the slide. The connector can be retained within a supporting housing (not shown) by a pair of enlarged portions 118 extending from the reduced thickness portions 116. The enlarged portions 118 can be supported in a pair of cylindrical apertures within the supporting housing to support the body portion 104.

In yet another embodiment, the connector body portion 104 can be supported within a cavity (not shown) within a supporting housing, and a compressible foam 120 trapped within the housing cavity may be used to exert a biasing force onto the connector body 104 to urge the contacts 110 into engagement with the reagent strip. A pair of stops 122 and 124 can be used to engage a pair of stops (not shown) within the supporting housing to retain the connector housing 104 within the cavity against biasing force of the compressible foam 120.

Obviously, many modifications and variations of the present invention are possible in light of the above teachings. Thus, it is to be understood that, within the scope of the appended claims, the invention may be practiced otherwise than as specifically described above.

What is claimed and desired to be secured by letters patent of the United States is:

1. A reagent strip calibration system comprising a) a one-time use reagent strip having areas of differing resistance, and b) a connector usable for contacting said one-time use reagent strip by physical displacement composed of a base, an elongated resilient member disposed on said base, a plurality of generally U-shaped, nonresilient, hard, electrically conductive wires disposed in a substantially parallel relationship about said elongated elastomeric member and supported thereby, and means defining a completely open cavity adjacent said conductive wires for receiving said one-time use reagent strip, said cavity being dimensioned so that said one-time use reagent strip compresses said nonresilient, hard, electrically conductive wires when the one-time use reagent strip is inserted into said cavity causing said wires to become biased against said one-time use reagent strip.

2. The reagent strip calibration system of claim 1 wherein said nonresilient, hard, electrically conductive wires are composed of tungsten.

3. The reagent strip calibration system of claim 1 wherein said nonresilient, hard, electrically conductive wires are composed of beryllium copper.

4. The reagent strip calibration system of claim 1 wherein said nonresilient, hard, electrically conductive wires are compose of nickel/iron alloy.

5. The reagent strip calibration system of claim 1 wherein said elongated elastomeric member is fabricated from butadiene rubber.

6. The reagent strip calibration system of claim 1 wherein said elongated elastomeric member is fabricated from butyl rubber.

7. The reagent strip calibration system of claim 1 wherein said elongated elastomeric member is fabricated from polychloroprene.

8. The reagent strip calibration system of claim 1 wherein said elongated elastomeric member is fabricated from natural rubber.

* * * * *